United States Patent [19]

Kreuter

[11] Patent Number: 4,715,332

[45] Date of Patent: Dec. 29, 1987

[54] ELECTROMAGNETICALLY-ACTUATED POSITIONING SYSTEM

[76] Inventor: Peter Kreuter, Josef-Ponten Str. 38, 5100 Aachen, Fed. Rep. of Germany

[21] Appl. No.: 850,939

[22] Filed: Apr. 11, 1986

[30] Foreign Application Priority Data

Apr. 12, 1985 [DE] Fed. Rep. of Germany ..... 3513103

[51] Int. Cl.[4] ..... F01L 9/04; H01F 7/08

[52] U.S. Cl. ..... 123/90.11; 251/129.1; 251/129.16; 251/129.18; 335/266

[58] Field of Search ..... 123/90.11; 251/129.09, 251/129.1, 129.16, 129.18; 335/256, 258, 262, 266, 268

[56] References Cited

U.S. PATENT DOCUMENTS 4,455,543 6/1984 Pischinger et al. ..... 335/266

FOREIGN PATENT DOCUMENTS 615997 1/1949 United Kingdom ..... 251/129.16

1291765 10/1972 United Kingdom ..... 251/129.16

*Primary Examiner*—Tony M. Argenbright

*Attorney, Agent, or Firm*—Jacques M. Dulin

[57] ABSTRACT

Apparatus and method for control of actuator anchor plate release time in spring-biased electromagnetically-actuated positioning systems for gas exchange valves in internal combustion engines in which a ferromagnetic actuator anchor plate is moved back and forth between two actuating solenoids. Pursuant to the invention, the poles of the solenoid core and the anchor plate are separated by a member which may be formed of an electrically-nonconductive, paramagnetic or diamagnetic layer, or an air gap. This provides magnetic resistance in the magnetic circuit which reduces generation and propagation of eddy currents in the anchor plate. The magnetic field can decay more rapidly upon cut-off of current to the solenoid coil. The release time of the anchor plate from the actuating solenoid is thereby diminished, and more accurate valve dwell timing is achieved for improved engine performance.

20 Claims, 2 Drawing Figures

ELECTROMAGNETICALLY-ACTUATED POSITIONING SYSTEM

FIELD

The invention concerns apparatus and methods for control of actuator anchor plate release time in electromagnetically-actuated positioning mechanisms for reciprocating actuators, particularly for lifting valves in displacement machines such as gas exchange valves in internal combustion engines. These positioning mechanisms typically have two spaced-apart electrically-operated actuating solenoids by means of which a spring-loaded actuator anchor plate disposed therebetween may be moved between two discrete, mutually-opposite operating positions. The ferromagnetic anchor plate is selectively held at the particular operating position by energizing a solenoid for a desired time period. The invention is characterized by providing a magnetic resistance or insulation inserted in the magnetic flux of the magnetic circuit developed between the solenoid core and the ferromagnetic anchor plate for adjustment of the release time of the anchor plate.

BACKGROUND

A comparable positioning system is known from DE-OS No. 30 24 109 corresponding to U.S. Pat. No. 4,455,543. The state of the art describes a positioning system including an anchor plate on an actuator which may be shifted back and forth between two actuating solenoids. In one operating position, the anchor plate is held by one of the actuating solenoids, while in the other operating position the anchor plate is held by another actuating solenoid situated opposite its counterpart.

While the anchor plate is being held in one operating position as a result of current flow through one actuating solenoid, the other actuating solenoid is simultaneously energized. The operating positions are changed due to the fact that the actuating solenoid within whose attractive field the anchor plate is situated is de-energized, whereby the spring-loaded anchor plate is driven toward and seized by the other actuating solenoid.

The precise moment of switchover is thus defined by the de-energizing, and not by the energizing, of an actuating solenoid.

A problem is raised by the fact that, due to eddy currents generated in the solenoid core, the decay of the magnetic field cannot be accurately defined, resulting in uncertainty concerning the precise moment of release of the anchor plate from the pole face of the core of the just de-energized solenoid.

Accordingly, there is a need in the art for electromagnetically-actuated positioning systems in which the ferromagnetic actuator anchor plate dwell period and release times are precisely known and can be adjusted to predetermined desired times for each particular application.

THE INVENTION

Objects:

It is among the objects of the invention to create a type-conformable device for which the moment of change in operating position of valve actuators is accurately adjustable.

It is another object of the invention to provide a magnetic resistance for adjustment of the release time of a ferromagnetic anchor plate of an electromagnetically-actuated positioning system.

It is another object of the invention to provide a magnetic insulation or resistance in the magnetic circuit set up by adjusting solenoid magnetic flux to permit adjustment and control of the release and/or dwell time of the anchor plate.

It is another object of the invention to provide a means permitting precise control of the time of release of the anchor plate which time may be preselected for each particular application.

It is another object of the invention to provide for improved engine performance by providing a system for improved valve actuation control and timing.

These and other objects of the invention will be evident from the specification, drawings and claims.

DRAWINGS

The invention is described in more particularity below with reference to the figures in which:

FIG. 1 is a side elevation view, partly in cross-section, showing the location of the magnetic resistance assembly in relation to the actuator anchor plate of the electromagnetically-actuated positioning mechanism of this invention; and FIG. 2 is an enlarged section view of Detail A of FIG. 1.

SUMMARY

Electromagnetically-actuated positioning mechanisms typically have a valve actuator assembly which includes a tappet which contacts the end of the stem of a lifting valve, and a disc-shaped ferromagnetic anchor plate element which is alternately attracted to each of a pair of spaced-apart, discrete, mutually-opposite actuating solenoids, when each is appropriately energized, to define two operating positions, e.g., valve open and valve closed. The invention comprises providing at least one magnetic resistance for adjustment and/or control of the release and/or dwell time of the actuator anchor plate, which resistance is inserted in the magnetic circuit set up by the magnetic flux.

Pursuant to the invention, a magnetic resistance which does not conduct magnetic flux lines by means of a ferromagnetically-conductive or electrically-conductive material, is inserted in the magnetic field between the actuator anchor plate and the magnet core of one or more of the actuating solenoids which attracts this anchor plate. The generation and propagation of eddy currents within the anchor plate are thus reduced, and the magnetic field can thereby decay more rapidly upon interruption of current flow when the solenoid is de-energized.

The magnetic resistance may be formed by an empty space or air gap, or by an electrically-nonconductive material disposed between the pole face of the actuating solenoid core and the anchor plate. The resistance element may be a non-ferromagnetic material secured to the pole face or the anchor plate face.

Depending on requirements, the width of the gaps or resistance element material on each side of the anchor plate may vary greatly. Reference to "gap" herein is a reference either to air gap or width (thickness) of the material forming the magnetic resistance element (member). The wider the gap or thicker the resistance element, the more accurately predictable the release point; on the other hand, the force required of the solenoid for holding the anchor plate is also larger. More accurate timing is counterbalanced by increased energy consumption, and it is necessary to evaluate the degree to which increased energy consumption is justified, in the particular application at hand, for enhancing the accuracy of operation timing. Preferably, the magnetic resistance is greater in one operating position than the other.

If the invention is used for actuation of the intake valve of an internal combustion engine, for example, the moment of intake-valve opening is relatively non-critical, as the piston is then at top dead center and the engine's intake phase is gradually commencing. The moment of valve closing is critical, however, as combustion-chamber filling significantly dependent on the exact moment at which the intake valve is closed during the phase of strong suction under vacuum conditions. It is consequently important to be able to accurately determine and control the change-over from open to closed position. In accord with the invention, this is done by providing that the dimension of the gap between the anchor plate and the actuating solenoid holding the valve in its "open" position is larger than that of the gap on the other side of the anchor plate corresponding to the valve "closed" position.

DETAILED DESCRIPTION OF THE BEST MODE OF THE INVENTION

In the following detailed description, the invention is described with reference to the figures. This description of the best mode of carrying out the invention is by way of limitation of the principles of the invention.

Figure 1:
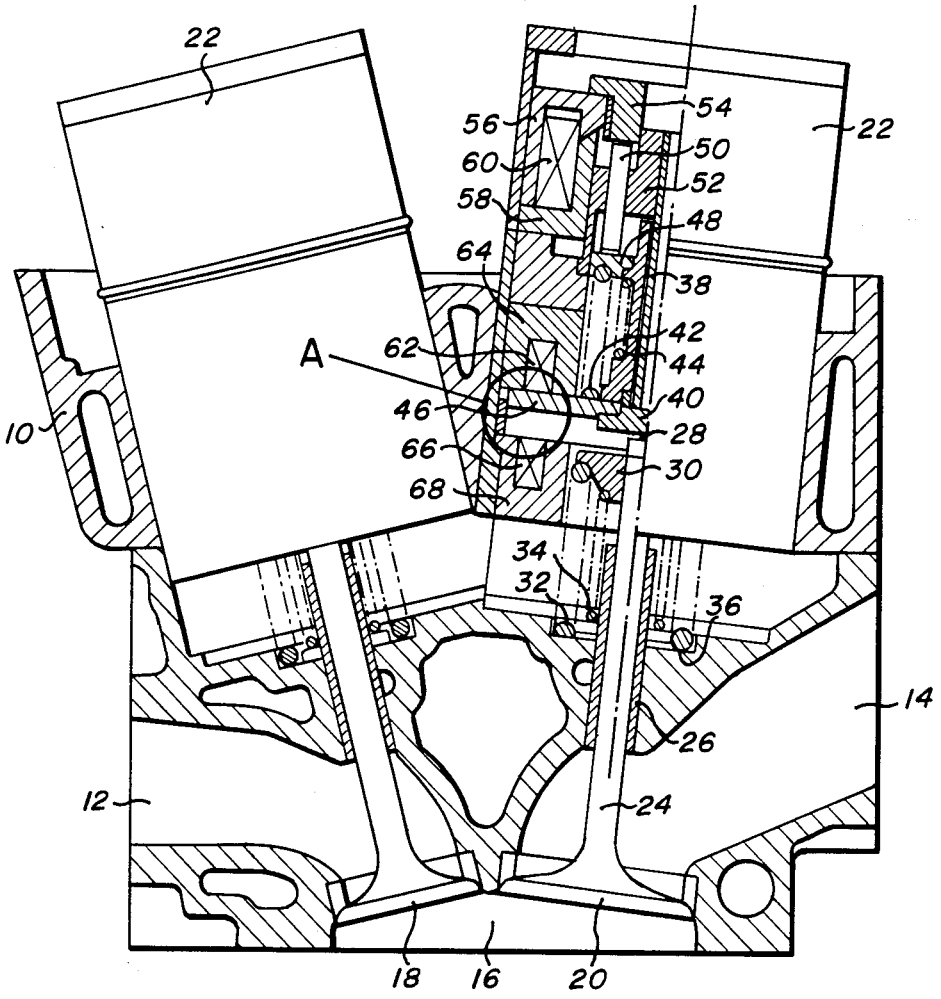

FIG. 1 illustrates a cross-section from the engine block of an internal combustion engine. Item 10 indicates the cylinder head. An exhaust port 14, which may be selectively closed with an exhaust valve 20, leads out of cylinder bore 16. An intake port 12, which may be selectively closed with an intake valve 18, leads into cylinder bore 16. Valves 18 and 20 are actuated by an electromagnetic positioning system situated in housing 22. It is possible to match intake and exhaust valve characteristics to specific design requirements; it may thus be observed in FIG. 1 that the disk of exhaust valve 20 is larger than the disk of intake valve 18.

As there is no theoretical difference between intake and exhaust valve construction, the following discussion will refer to the exhaust valve only.

Valve disk 20 is integral with valve stem 24 which slides in valve guide 26, inserted in cylinder head 10. The end of valve stem 24, indicated as item 28, has a bearing surface which contacts a tappet 40 of the actuator assembly, to be described below.

A flange 30 is circumferentially mounted on the end of valve stem 24 opposite valve disk 20. Flange 30 acts as a seat for a spring system consisting of a large spiral spring 32 and a small spiral spring 34. Both spiral springs 32 and 34 are coaxially installed. The opposite spring seat 36 is formed by a bearing surface in the cylinder head. Valve stem 24 may be actuated in valve guide 26 against the loading of springs 32 and 34, causing valve disk 20 to rise off its seat and open exhaust port 14.

An axial extension to valve stem 24 is formed by actuator rod 38, the lower end of which is fitted with tappet 40, which makes contact with valve stem 26. An annular anchor plate 46, made of ferromagnetic material, is fastened to actuator rod 38 in the region of tappet 40. This anchor plate also supports a spring system consisting of a large spiral spring 42 and small spiral spring 44, which are also coaxial to one another and to rod 38. The actuator assembly thus comprises actuator rod 38, tappet 40 and anchor plate 46.

The seat for this loading system 42 and 44 is formed by a support 48, described in greater detail below.

A magnet core 68 having a U-shaped cross-section is annularly installed about flange 30, with the axis of the annulus coinciding with the axis of valve stem 24. A coil 66 is situated inside magnet core 68. The open side of U-sectioned magnet core 68 faces in the direction of anchor plate 46.

Actuator rod 38 is likewise surrounded by a similarly shaped magnet core 64, inside of which is a coil 62. Depending on which of solenoids 62 and 66 is energized, anchor plate 46 moves from a contact fact on magnet core 64 to a contact face on magnet core 68, and back again.

Also provided is an adjusting solenoid consisting of a magnet core 58 and a coil 60. Energizing coil 60 attracts ferromagnetic component 56, which is joined to part 54. This movement, caused by energizing adjusting solenoid coil 60, and acting on part 54, is transmitted by means of pin 50, placed in a cover plate 52 to the spring-system seat formed by support 48. Thus, energizing adjusting solenoid coil 60 shifts the seat of springs 42 and 44.

Anchor plate 46 is held in one of its operating positions by core 64 due to current flow through coil 62; this results in valve 20 being closed. In its other operating position, anchor plate 46 is held by core 68 due to current flow through coil 66; as a result, valve 20 is open.

Figure 2:
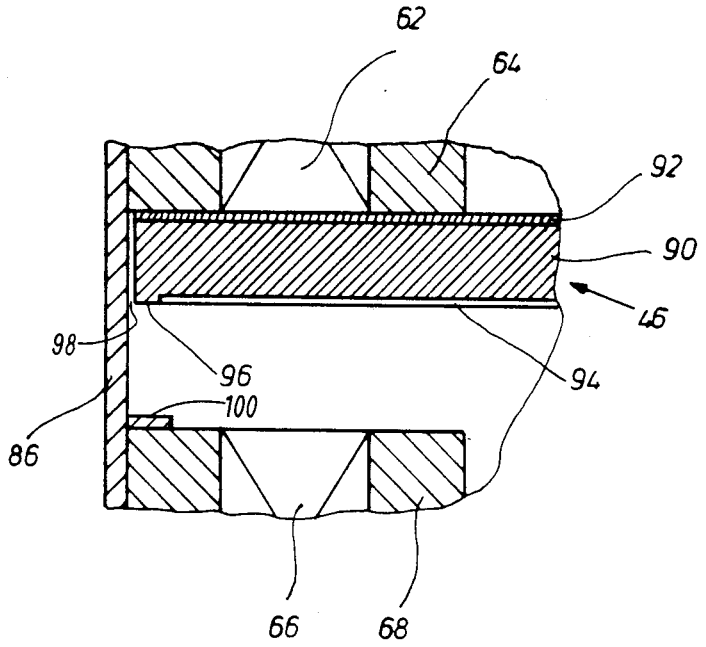

FIG. 2 provides a more detailed view of the region of solenoid cores 68 and 64, together with coils 62 and 66, and their interaction with anchor plate 46. Anchor plate 46 travels inside, but does not touch, sleeve 86, as shown by clearance gap 98. FIG. 2 shows the anchor plate with valve 20 in its "closed" position. The anchor plate, shown in cross-section, is nonetheless not continuous, but consists of a plate 90, made of ferromagnetic material and topped by a layer 92 which, as shown in FIG. 2, is resting in contact with the pole faces of solenoid core 64.

Layer 92 acts to prevent, to the greatest degree possible, the propagation of eddy currents from one leg of the U-section solenoid core through anchor plate 90 to the other leg of the core. Layer 92 also acts to ensure that the magnetic lines of force in the region of layer 92 show a behavior typical of paramagnetic or diamagnetic materials, which differs from their behavior in ferromagnetic materials. Insofar as the magnetic effect and resulting eddy currents are concerned, then, layer 92 behaves like an air gap. When magnetic lines of force are present between the two poles of U-section solenoid core 64, these lines of force enter the ferromagnetic material 90 of anchor plate 46 only at a certain distance from the pole of solenoid core 64, and anchor plate 46 is not held against the poles of core 64 with as much force as it would be if layer 92 were also made of a ferromagnetic material. Due to the presence of layer 92, then, development of a comparable force would require a larger solenoid.

On the other hand, the induction of eddy currents is diminished so that, when coil 62 is de-energized, magnetic field 64 collapses more rapidly and anchor plate 46 is thus released at a more accurately-predictable moment and, above all, more rapidly. For example, for a resistance of 0.3 mm there is a corresponding improvement in release time of 2 milliseconds.

A projection 96 may be seen running axially along the bottom outer circumference of anchor plate 46. This projection comes into contact with one pole of U-section solenoid core 68, such that the pole of core 68 touches only projection 96 of anchor plate 46, while the remainder of the core is separated from the face of anchor plate 46 by gap 94. In this variant, then, the gap is not formed by a layer 92, but instead by an actual air gap 94.

In an alternate embodiment, instead of a projection 96, a corresponding radial projection 100 can be provided in the internal circumference of lateral sleeve 86 (in which anchor plate 46 moves) against which projection anchor plate 46 would abut. The important factor is the isolating distance between anchor plate 46 and the poles of solenoid core 68.

In practice, as mentioned above, a compromise must be sought between: (a) larger solenoid dimensioning necessitated by gap distance, and (b) desirably predictable and more rapid actuating times. If one of the two actuating solenoids 62 or 66 proves to be more critical than the other in terms of accurate, rapid actuating times, it may be correspondingly dimensioned somewhat larger. The gap between anchor plate 46 and the actuating solenoid may then be increased to provide more accurate control of release and/or dwell timing. If a completely symmetrical construction is desired, however, the dimensioning of solenoids 62 and 66 is to be calculated on the basis of the larger of the two gaps.

As a result of the more precise actuator release timing afforded by the proper location of the magnetic resistance means of this invention, engine performance may be improved.

It should be understood that various modifications within the scope of this invention can be made by one of ordinary skill in the art without departing from the spirit thereof. I therefore wish my invention to be defined by the scope of the appended claims as broadly as the prior art will permit, and in view of this specification if need be.

I claim:

1. Apparatus for improved control of release of an actuator anchor plate in an electromagnetically-actuated positioning mechanism for a valve-type reciprocating actuator assembly in a displacement machine, comprising in operative combination:

(a) at least one actuating solenoid having a core with a contact face disposed to selectively attract a ferromagnetic valve actuator assembly anchor plate to a first operating position;

(b) a ferromagnetic actuator assembly anchor plate having a contact face corresponding to and opposed from said solenoid contact face, and said anchor plate is disposed to be magnetically attractable to and releasable from said solenoid core, said anchor plate extending substantially entirely across said core face; and (c) said actuating solenoid core and said anchor plate are disposed with respect to each other to provide therebetween magnetic resistance in the magnetic circuit set up by the magnetic flux of said core, said magnetic resistance extending substantially across said contact faces and being sufficient to reduce generation and propagation of eddy currents in said anchor plate resulting in rapid magnetic field decay upon cut-off of current to said actuating solenoid coil, thereby reducing the release time of said anchor plate from said actuating solenoid.

2. An improved anchor plate release system as in claim 1 wherein:

(a) said magnetic resistance includes means for providing a space between said solenoid core face and said corresponding contact face of said anchor plate.

3. An improved anchor plate release system as in claim 1 wherein:

(a) said magnetic resistance includes a non-ferromagnetic member disposed between said solenoid core face and said corresponding contact face of said anchor plate.

4. An improved anchor plate release system as in claim 3 wherein:

(a) said magnetic resistance member is selected from a diamagnetic and a paramagnetic material.

5. An improved anchor plate release system as in claim 3 wherein:

(a) said magnetic resistance member is disposed secured to said solenoid core face.

6. An improved anchor plate release system as in claim 3 wherein:

(a) said magnetic resistance member is disposed secured to said contact of said anchor plate.

7. An improved anchor plate release system as in claim 1 wherein:

(a) said magnetic resistance includes means for providing a space between said solenoid core face and said corresponding contact fact of said anchor plate; and (b) said magnetic resistance includes a non-ferromagnetic member disposed between said solenoid core face and said corresponding contact face of said anchor plate.

8. An improved anchor plate release system as in claim 1 wherein:

(a) said positioning mechanism includes a pair of spaced-apart actuating solenoids each of which has a contact face;

(b) said anchor plate has a contact face disposed in each side thereof, and is disposed between said solenoids so that it may be alternately moved between said solenoid core faces into two discrete mutually-opposite operating positions upon selective energizing and de-energizing of said solenoids; and (c) said magnetic resistance is disposed between each of said solenoid core faces and their corresponding anchor plate contact faces.

9. An improved anchor plate release system as in claim 8 wherein:

(a) at least one of said magnetic resistances includes means for providing a space between said solenoid core face and a corresponding contact face of said anchor plate.

10. An improved anchor plate release system as in claim 8 wherein:

(a) at least one of said magnetic resistances includes a non-ferromagnetic member disposed between said solenoid core face and a corresponding contact face of said anchor plate.

11. An improved anchor plate release system as in claim 9 wherein:

(a) at least one of said magnetic resistances includes a non-ferromagnetic member disposed between said solenoid core face and a corresponding contact face of said anchor plate.

12. An improved anchor plate release system as in claim 1 wherein:

(a) said positioning mechanism includes a pair of spaced-apart actuating solenoids, each of which has a contact face;

(b) said anchor plate has a contact face disposed in each side thereof, and is disposed between said solenoids so that it may be alternately moved between said solenoid core faces into two discrete mutually-opposite operating positions upon selective energizing and de-energizing of said solenoids; and (c) the magnetic resistance is greater when said anchor plate is in one operating position than the other.

13. An improved anchor plate release system as in claim 12 wherein:

(a) said positioning mechanism is disposed in association with at least one gas exchange valve in an internal combustion engine, said valve having a first, open operating position and a second, closed operating position; and (b) the magnetic resistance between said anchor plate and said corresponding solenoid core face is greater when said valve is in said open position than when said valve is in said closed position.

14. An improved anchor plate release system as in claim 13 wherein:

(a) said valve is an exhaust valve.

15. An improved anchor plate release system as in claim 2 wherein:

(a) said positioning mechanism is disposed in association with at least one gas exchange valve in an internal combustion engine.

16. An improved anchor plate release system as in claim 3 wherein:

(a) said positioning mechanism is disposed in association with at least one gas exchange valve in an internal combustion engine.

17. An improved anchor plate release system as in claim 8 wherein:

(a) said positioning mechanism is disposed in association with at least one gas exchange valve in an internal combustion engine.

18. An improved anchor plate release system as in claim 16 wherein:

(a) said valve is an exhaust valve.

19. Method of improving control of release of a ferromagnetic actuator anchor plate in an electromechanically-actuated positioning mechanism having actuating solenoids for a valve-type reciprocating actuator assembly in a displacement machine, comprising the steps of:

(a) inserting a magnetic resistance between said ferromagnetic actuator anchor plate and at least one actuating solenoid substantially entirely across the lateral extent therebetween in an amount sufficient to reduce generation and propagation of eddy currents in said anchor plate and improve magnetic field decay upon cut-off of current to said actuating coil; and (b) cutting off said current to said actuating coil at a predetermined time in relation to the time of desired release of said anchor plate from said solenoid core face.

20. A method as in claim 19 wherein said positioning mechanism includes at least a first and a second opposed actuating solenoid having said anchor plate disposed therebetween for alternately attracting said anchor plate into two discrete, mutually-opposite operating positions, (a) energizing said first coil to attract said anchor plate thereto for a predetermined time period;

(b) energizing said second coil prior to the end of said time period; and (c) de-energizing said first coil to permit release of said anchor plate from said first coil and attraction by said second coil.

* * * * *